United States Patent [19]

Grycel, III

[11] 4,044,414

[45] Aug. 30, 1977

[54] BOAT CONSTRUCTION AND MOLD

[76] Inventor: Felix John Grycel, III, 14322 Emelita, Van Nuys, Calif. 91401

[21] Appl. No.: 698,953

[22] Filed: June 23, 1976

[51] Int. Cl.[2] ..... B63B 3/00

[52] U.S. Cl. ..... 9/6 R; 9/6 M; 9/6 P; 9/6 W; 29/423; 29/428; 29/457; 29/462; 46/1 R; 46/93

[58] Field of Search ..... 9/6; 114/65; 46/1 R, 46/93; 29/469, 428, 423, 457, 462; 156/212

[56] References Cited

U.S. PATENT DOCUMENTS

| | | | |
|---|---|---|---|
| 2,411,497 | 11/1946 | Barnes | 156/212 |
| 2,773,273 | 12/1956 | Drake | 156/212 X |
| 3,793,768 | 2/1974 | Surving | 46/1 R |

FOREIGN PATENT DOCUMENTS

| | | | |
|---|---|---|---|
| 1,091,399 | 11/1967 | United Kingdom | 114/65 R |

*Primary Examiner*—Trygve M. Blix
*Assistant Examiner*—Sherman D. Basinger
*Attorney, Agent, or Firm*—Robert G. Upton

[57] ABSTRACT

A boat construction apparatus and method which comprises a mold assembly with integral frames, stem, knee and keel. The mold assembly consists of a base support portion with a series of frame support members perpendicular to and affixed to the base portion. A center backbone keel support member is interlocked with each of the frame member, the backbone keel is also affixed to and perpendicular to the base portion. The frame support members and backbone are partially pre-cut so that the boat frames and the keel portion are integral with the frame supports and backbone during boat hull construction. After the hull is constructed over the frame support members and backbone support member, the boat frame and keel portion are cut away from the integral support portions, thus freeing the boat hull from the support segment of the frames and backbone.

11 Claims, 7 Drawing Figures

BOAT CONSTRUCTION AND MOLD

BACKGROUND OF THE INVENTION

In the boat construction business it is normal to construct the hull of the boat upside down over a permanent type of mold or armature. Generally, in conventional boat construction a central vertically extending keel support member is supported by a series of frame support cross-members affixed to the keel support member so that the boat frames may be clamped to the mold during the hull construction phase. The frames are first bolted or clamped to the frame support cross-members followed by clamping the keel to the keel support member. The addition of the stem, knee bottom and sides over the permanent armature or mold subsequently follows. After the hull of a conventional boat is assambled over the forgoing mold assembly, all of the frames must then be unbolted or unclamped from the frame support cross-members as well as the portion of the hull which is connected or attached to the keel support member, thus taking considerable time and effort to free the basic hull from the mold assembly.

Additionally, the mold of the conventional construction technique must have the proper shape of the hull, thus the builder must do twice the work that is involved in the integral frame and support of the mold assembly method of the present invention.

The foregoing conventional hull construction method is only one of several other conventional boat building techniques.

This method of construction is disadvantaged in that it takes considerable time to affix and disengage each frame member to each frame support cross-member and the keel to the keel support of the permanent armature or mold assembly.

A patent issued to R. A. Surving, U.S. Pat. No. 3,793,768, discloses a model kit that utilizes a temporary armature for the construction of a hull assembly.

The armature or mold is comprised of a printed pattern on cardboard or the like. The pattern includes frame members and a keel. The frames and keel are interlocked with slots formed by the frames and keel. The interlocked frames and keel are mounted to a base portion and the armature is then used to fabricate a model boat hull. The armature is first taped with adhesive tape and subsequently covered with a mesh material. The mesh is then coated with a self-hardening modeling compound. After the compound hardens the hull is removed from the armature and the armature is discarded.

This invention is disadvantaged in that no part of the temporary armature is used as a structural part of the hull after the hull is finished as does the present invention.

Additionally the invention is further disadvantaged in that the armature is difficult to remove from the adhesive tape. In the instant invention, the hull frames and keel are simply cut from the armature or mold assembly.

SUMMARY OF THE INVENTION

A method of constructing a boat hull comprising the steps of:

Forming a mold base member to support a mold assembly. The mold assembly consists of cutting a first peripheral outline of each of one or more frame members from basic boat construction material; the material serves as a frame support member for the frame members of the hull. A second side is cut opposite each frame peripheral outline a predetermined distance from the peripheral edge so that the second side will mate with the mold base member. The material is partially cut to form the inwardly facing edge of each frame member without removing the frame from the basic boat construction material; each partially cut frame member is an integral part of the material. The second cut side of the material making up each of the one or more frame members is attached to the base portion of the mold assembly; the material is affixed substantially perpendicular to and in substantially spaced parallel relationship with each of the other of the frame members. Bottom members of the hull formed from suitable boat construction material is attached to each of the one or more partially cut frame members affixed to the mold assembly base portion. The sides, stem, knee and transom are attached to an edge of the one or more bottom portions and to each of the one or more partially cut frame member, partially completing the hull. Each frame member is severed from its integral frame support member affixed to the mold assembly base after the hull is completed. The hull is then removed from the severed support member affixed to the mold or armature assembly base.

The boat construction material may be selected from plywood, metal, plastic, wood, paper, cardboard, fiberglass or any combination of the foregoing.

Plywood is an ideal material in that each frame may be cut peripherally with the inner edge partially cut from the basic plywood material, the opposite edge of the plywood is cut to conform to the armature base structure.

Where model boats are fabricated, paper of various ply and thickness may be utilized effectively. For example, pre-printed boat components may be die cut from, for example, two or three ply bristol board made by Green Industries, Division of Excelsior-Legal Stationery Company, Inc. of New York, N.Y. 10013. The frames, keel, stem, knee, sheer clamp segments, bottom, sides and transom making up a basic hull may be die cut from paper products. The frame support and keel backbond support is an integral part of the frames and keel, the interfitting members being assembled and affixed to a mold base member during hull construction. As heretofore mentioned the hull, when completed is severed from the frame and keel backbond supports. Thus, a model boat hull or a full size hull may be quickly and accurately assembled on the integral mold.

Therefore, it is an object of this invention to provide a method and apparatus to construct a boat hull.

More specifically, it is an object of this invention to provide a method and apparatus whereby the frame, frame support, keel and keel backbone are integral during boat hull construction, the frames and keel being severed from an anchored armature or mold upon completion of the hull.

An advantage over the prior art is the utilization of a mold with integral frames, stem, knee and keel during hull construction. The hull is cut from the mold. The frames, stem, knee and keel remain as structural parts of the hull.

Yet another advantage over conventional boat construction techniques is the ability to discard the mold or armature after completion of the hull, thus eliminating the need for storage of the mold assembly.

The above noted objects and advantages of the present invention will be more fully understood upon a study of the following detailed description in conjunction with the detailed drawings.

DESCRIPTION OF THE PREFERRED EMBODIMENTS

Figure 1:
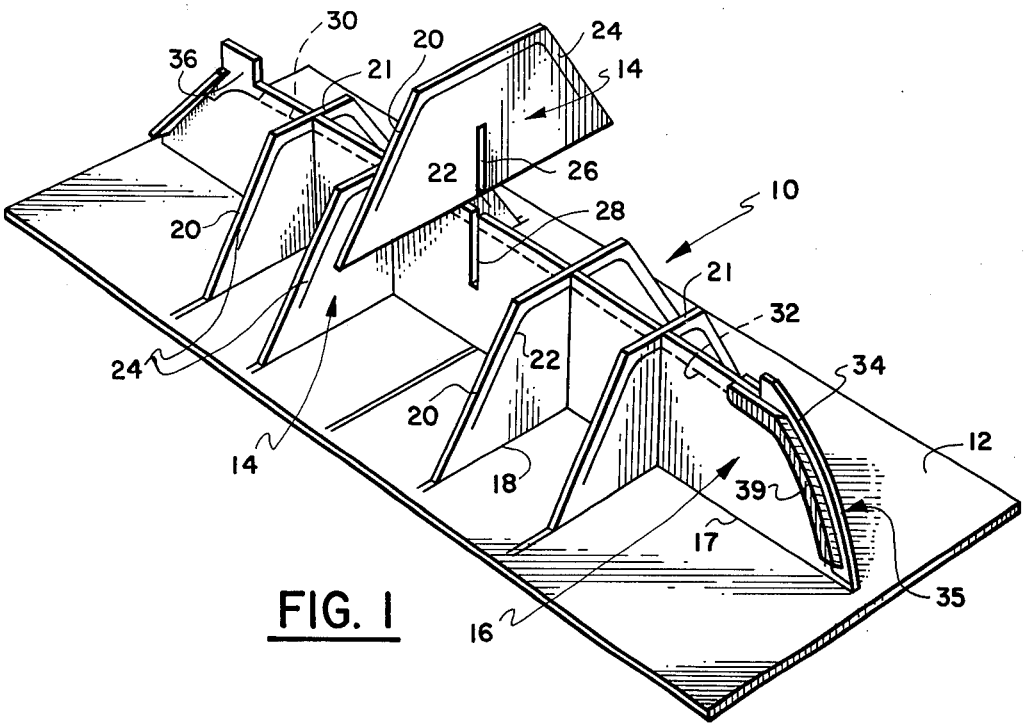
FIG. 1 is a perspective view of the basic mold assembly of the present invention.

Turning now to FIG. 1 the basic mold or armature assembly generally designated as 10, consists of a base structure or plate 12 with a series of vertically extending frame support members generally designated as 14 attached to the base 12. Each frame support 14 is interfitted with a vertically extending backbone support member generally designated as 16 perpendicular to each of the frame support members 14. The base 18 of frame support 14 is connected to base 12. The outer peripheral edge 20 of the frame support is cut from the basic frame material, the shape of which is predetermined by the design of the hull. The inner peripheral surface 22 of each frame 24 is partially cut into the basic frame support materials. The frame 24 and frame support 14 then are integral units during construction of the hull on the mold assembly 10. Each frame support 14 has a slot 26 formed by the frame support material. The slot 26 interfits with a slot 28 formed by the backbone support member 16 at right angles to each frame support 14. The support member 16 may be a keel support member as is depicted by the phantom line 30. The keel 32 is pre-cut from support member 16 in the same manner as the frames 24 are cut from the frame supports 14, the keel 32 and reel support 16 being integral during the construction of the hull. The shape of the keel 32 of course is determined by the basic design of the hull. It should be noted here however that there need not be a keel portion in the finished hull. For example, a "Grand Banks Dory" type of boat does not have a keel. The support member or backbone then has a partially cut stem 34 at the bow 34 of the Dorg and a knee 36 partially cut in the stern portion of backbone support member 16. A doubler 39 may be used to provide an attachment surface for the sides if desired. It would additionally be obvious to slot the frame supports and keel support in such a manner to leave the longitudinally extending keel portion 32 from bow to stern a solid piece (not shown). For example, a reverse slotting procedure could be utilized wherein the slot 26 would be from peripheral edge 20 part way through the frame support 14 and the slot 28 in keel support 16 would be from the base 17 part way through keel support 16. The frame support base 18 would first be anchored to base 12 followed by insertion of the keel support or backbone 16 into respective slots 26 and 28 therefore leaving the keel 32 intact.

The material utilized to form the integral frame 24, frame support 14 as well as the backbone/keel support 16, keel, stern and knee may be selected from plywood, metal, plastic and paper products or combinations of two or more of the above materials.

Figure 2:
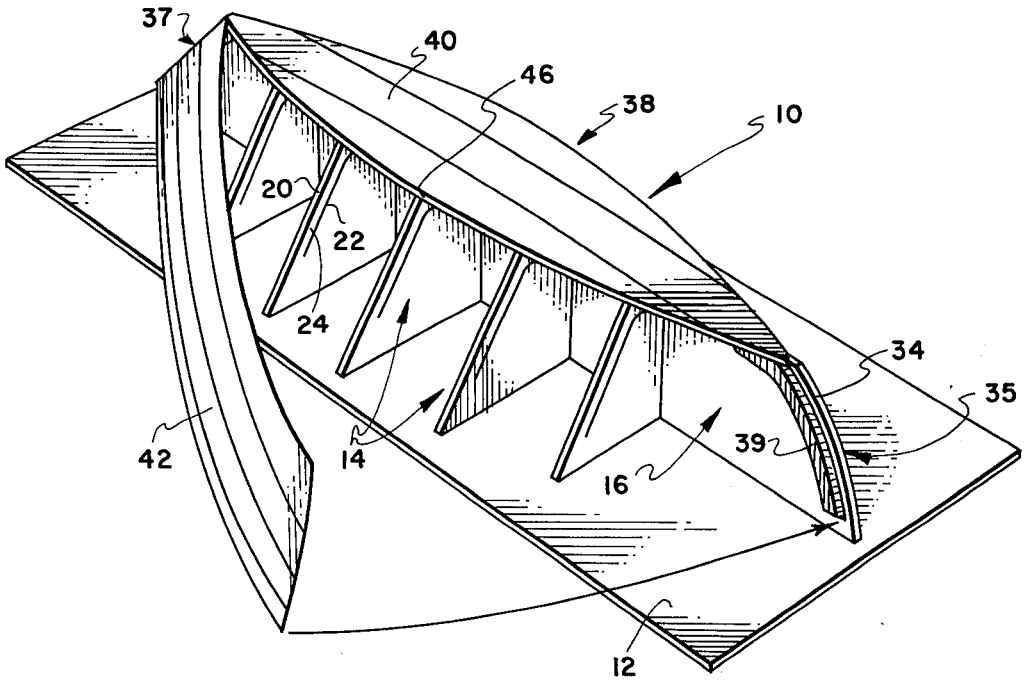
FIG. 2 is a perspective view of the mold assembly illustrating the application of the bottom and sides to the component member of the hull.
Figure 3:
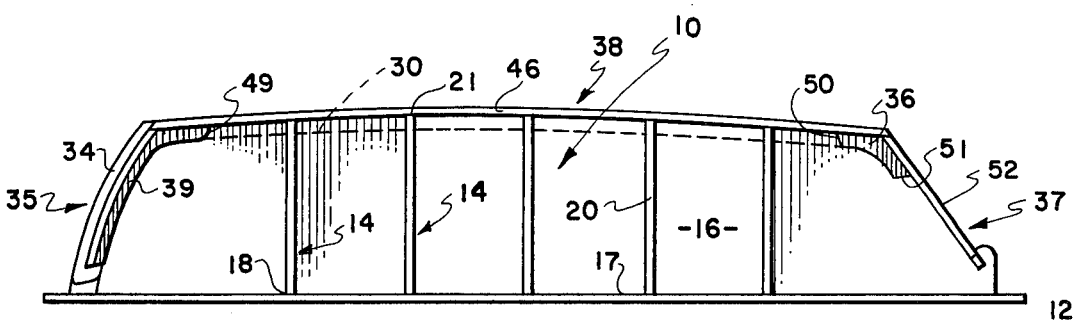
FIG. 3 is a side elevational view of the mold assembly with stem, knee, transom and bottom in place on the mold assembly.

Referring to FIG. 2, the hull generally designated as 38 of the Dory illustrated for example purposes only, is further assembled over the mold or armature assembly 16. The bottom sheet segment 40 is first attached to flat portion 21 of each of the frames 24. The chine surface 46 is subsequently bevelled to conform to the angle formed by each of the frame members 24, thus providing a flat surface for sides 42 to be joined to the sides of the frames and along the bottom chine edge 46. Before the sides are joined, however, the stem at bow 35 and the knee at stern 37 must be severed or cut from the backbone support 16 at points 49, 50 and 51 (FIG. 3). This should be accomplished before sides 42 are joined to the bottom 40 and frames 24 making up hull 38.

FIG. 3 further illustrates the spaced relationship of the frame supports 14. The transome 52 is normally attached to the knee segment 36 prior to attachment of the bottom 40 to the frames 24.

Figure 4:
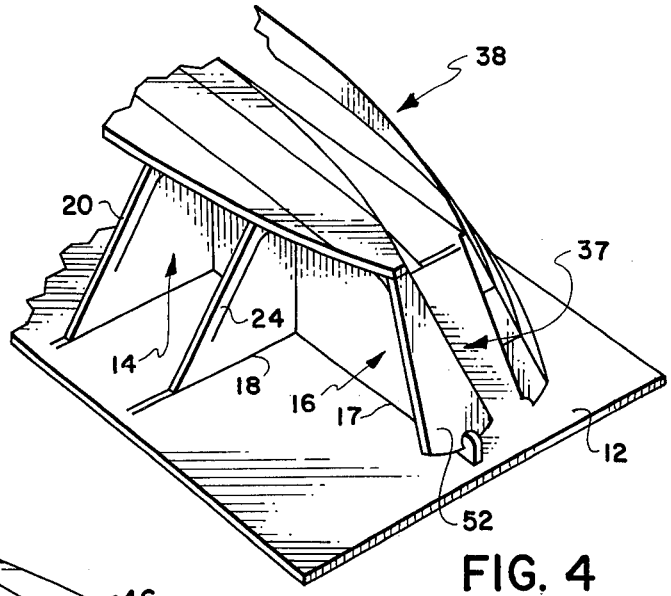
FIG. 4 is a partially cut-away perspective view of the mold assembly illustrating the stern end of the hull and application of the side panel thereon.

FIG. 4 illustrates the attachment of one of the sides 42 to the bottom 40 and transom 52 of stern 37.

Figure 5:
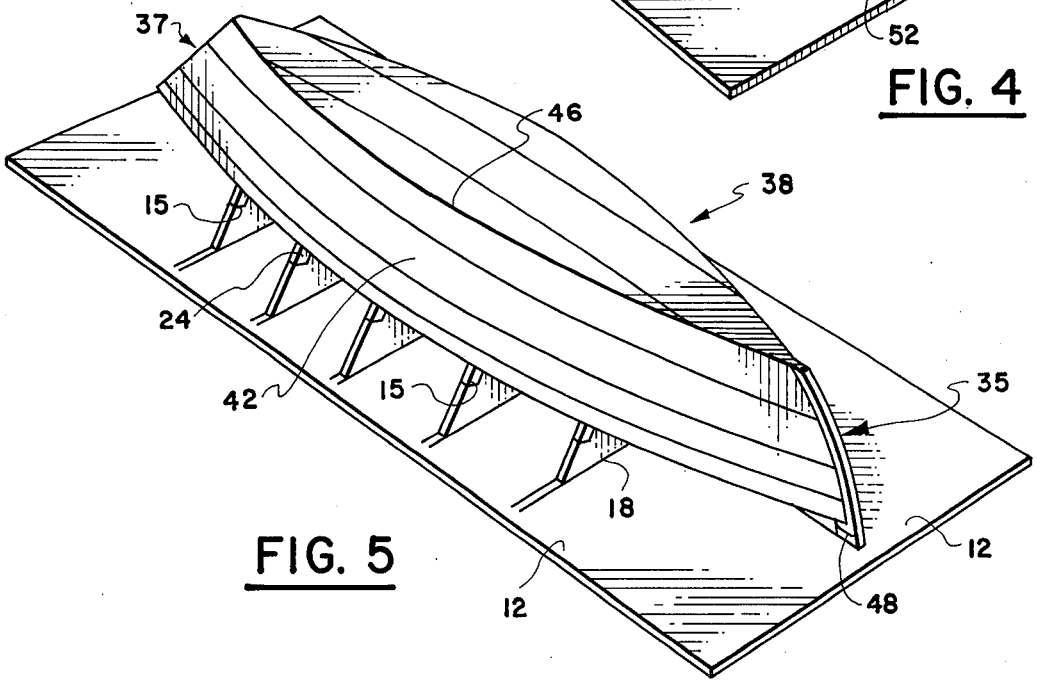
FIG. 5 is a perspective view of the nearly completed hull on the mold assembly.

FIG. 5 shows the basically completed hull 38 prior to removal of the hull from the mold assembly 10. It can readily be realized that during construction of the hull over the mold assembly, the mold assembly provides an extremely rugged and accurate jig for the hull assuring a straight and true hull structure upon completion. After the basic hull is completely assembled, it is then removed from the mold assembly by cutting or otherwise detaching the stem 34 from backbone 16 at point 48 and frames 24 from ach of the integral frame support members 14 at position 15 of each support structure 14 attached to base 12 of the mold assembly 10. The remaining severed supports 14, 16 and base 12 may then be discarded, thereby obviating any need to use up valuable shop space for storage of a conventional mold assembly as heretofore described.

Figure 6:
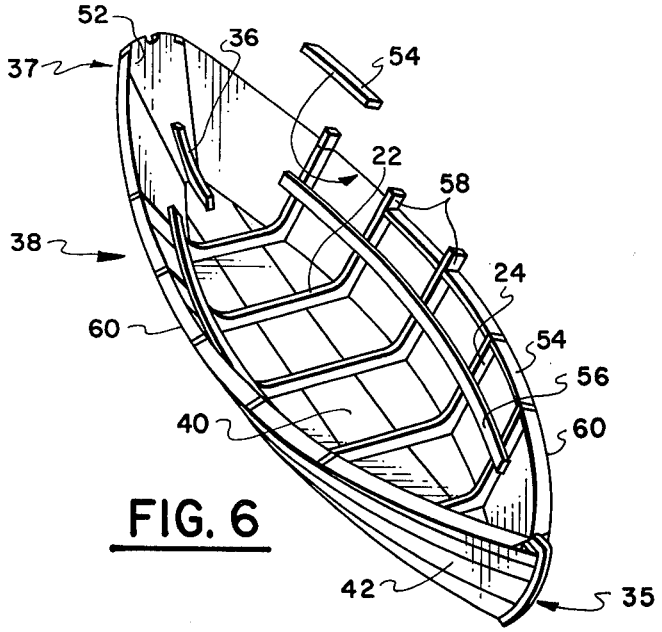
FIG. 6 is a perspective view of the hull after removal from the mold assembly showing the addition of sheer clamp segments.

FIG. 6 illustrates the hull 38 in an upright position. Sheer clamp segments 54 may then be interfitted between frame members 24. The excess frame material 58 extending above the rails or sheer clamp segments is then removed. The remaining surface provides a base for decking, hardward and/or trim to be attached thereto. Where paper is utilized as a fabrication material as in model boat construction, the sheer clamp segments 54 between frames 24 serve to prevent the sides from scalloping between frames. A clamp (not shown) is normally used in place of the sheer clamp segments. Stringers or clamps may of course, be used in place of the sheer clamp segments 54.

While a "Dory" is illustrated in the figures, it would be obvious to utilize the basic mold assembly to construct other types of hulls.

It would also be obvious to build other types of framed structures using the basic mold or armature assembly technique whether it is boats, aircraft components or the like.

Figure 7:
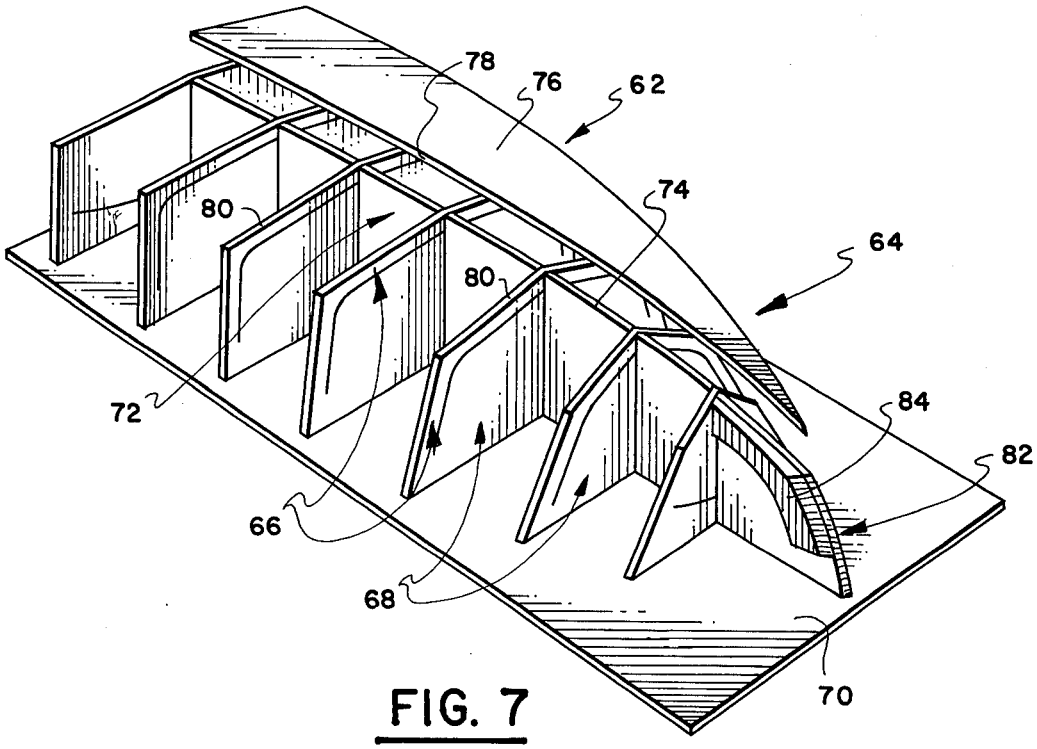
FIG. 7 is a perspective view of an alternative mold assembly wherein a "V" bottomed hull is to be assembled on a mold assembly.

Turning now to FIG. 7 a V-bottomed hull 62 is illustrated assembled over a mold assembly 64. Integral frames 66, frame support 68 are affixed to base 70 and a longitudinally extending backbone structure 72 is interlocked with the spaced, perpendicular frame supports 68. The crown 74 serves to support mating edge 78 of bottom segment 76. Crown 74 of backbone 72 is coated with a non-sticking substance such as a wax to prevent the joined parallel edges 78 of the pair of bottom segments 76 (only one is shown for clarity) from sticking to crown 74 of support 72 when the segments are secured to bottom surface 80 of each of the frames 66. Where, for example, plywood is used as a basic hull construction material, the bottom sheet segments 76 are glued to each frame member 66 and along the joined edges 78 of segments 76. The keel line formed by the glued mated edges 78 serve as a rigid keel when the glue is cured over the mold assembly. The adhesive material could be for example an epoxy type of glue. The hull 62 is completed upon additional of the stem 84 support at bow 82 and sides (not shown) to the bottom segments and frames. Keel battens or clamp segments may be positioned inside the hull along the keel line between each frame member 66 for strength after the hull 62 is removed from the mold assembly 64.

It would additionally be obvious to use chine segments between frames to provide strength and an attach point for the bottom panels whether the hull is flat bottomed, V-shaped or multi-chine.

It will of course be realized that various modifications can be made in the design and operation of the present invention without departing from the spirit thereof. Thus, while the principle, preferred construction, and mode of operation of the invention have been explained and what is now considered to represent its best embodiment has been illustrated and described, it should be understood that within the scope of the appended claims the invention may be practiced otherwise than as specifically illustrated and described.

I claim:

1. A method of constructing a framed structure comprising the steps of:

forming a mold base surface to support a mold assembly, forming a first peripheral edge of each of at least a pair of frame members from construction material, said material serves as a frame support member for said at least a pair of frame members of said structure, forming a second side substantially opposite each frame first peripheral edge a predetermined distance from said first peripheral edge, said second side forming a base for said at least a pair of frame support members, cutting partially through the frame support member forming each of said frame members to form a third inwardly facing edge of said frame member without removing said frame member from said frame support member, each partially cut frame member remaining an integral part of said support member, attaching said second side forming said base of said at least a pair of frame support members to said mold base surface, said frame support members being affixed substantially perpendicular to said mold base surface and in substantially spaced parallel relationship with each of the other of said at least a pair of frame support members, attaching at least one sheet member formed from said construction materials to the first peripheral edge of each of said at least a pair of partially cut frame members affixed to said mold base surface, severing each frame member from its frame support member affixed to said mold base surface, and removing said framed structure from said severed frame support members affixed to said mold base surface.

2. The invention as set forth in claim 1 wherein said framed structure is a boat hull, said at least one sheet member comprises the bottom surface of said boat hull.

3. The invention as set forth in claim 2 further comprising the steps of attaching a side, stem, knee and transom to an edge of said at least one bottom sheet member and to each of said at least a pair of partially cut frame members, partially completing said hull.

4. The invention as set forth in claim 3 further comprising the steps of:

forming an outer first peripheral edge of a keel member from said basic construction material, said material serving as a keel support member, forming a second side substantially opposite said first peripheral edge of said keel a predetermined distance from said first peripheral edge, said second side forming a base for said keel support member, cutting partially through said keel support member to form a third inwardly facing edge of said keel without removing said keel from said keel support member, said partially cut keel member remaining an integral part of said keel support member, attaching said second side forming said base of said keel support member to said mold base surface, said keel support member being affixed substantially perpendicular to said mold base surface and substantially at right angles to each of said at least a pair of frame support members, severing said keel member from said keel support member affixed to said mold base surface, and removing said framed structure from said severed frame support members and said keel support member affixed to said mold base surface.

5. The invention as set forth in claim 4, wherein said at least one frame support member and said keel support member are interlocked together through mating slots formed by said frame support member and said keel support member.

6. The invention as set forth in claim 5 wherein said boat hull is a model boat hull.

7. The invention as set forth in claim 1 wherein said basic construction material is plywood.

8. The invention as set forth in claim 1 wherein said basic construction material is metal.

9. The invention as set forth in claim 1 wherein said basic construction material is plastic.

10. The invention as set forth in claim 1 wherein said basic construction material is paper.

11. The invention as set forth in claim 1 further comprising the steps of:

interfitting and attaching at least one clamp segment between said at least a pair of frame members and said at least one sheet member, said at least one clamp segment serving to reinforce said framed structure.

* * * * *